US010370796B2

(12) United States Patent
Kawagoe et al.

(10) Patent No.: US 10,370,796 B2
(45) Date of Patent: Aug. 6, 2019

(54) PAPER COMPOSITE, PACKAGING MATERIAL, AND PRODUCTION METHOD OF PAPER COMPOSITE

(71) Applicants: KURARAY CO., LTD., Kurashiki-shi (JP); AGC Inc., Chiyoda-ku (JP)

(72) Inventors: Masako Kawagoe, Tsukuba (JP); Yosuke Kumaki, Kurashiki (JP); Sho Masuda, Chiyoda-ku (JP); Junsuke Kawana, Chiyoda-ku (JP)

(73) Assignees: KURARAY CO., LTD., Kurashiki-shi (JP); AGC Inc., Chiyoda-ku (JP)

( * ) Notice: Subject to any disclaimer, the term of this patent is extended or adjusted under 35 U.S.C. 154(b) by 216 days.

(21) Appl. No.: 15/504,730

(22) PCT Filed: Aug. 19, 2015

(86) PCT No.: PCT/JP2015/073280
§ 371 (c)(1),
(2) Date: Feb. 17, 2017

(87) PCT Pub. No.: WO2016/027841
PCT Pub. Date: Feb. 25, 2016

(65) Prior Publication Data

US 2017/0268175 A1 Sep. 21, 2017

(30) Foreign Application Priority Data

Aug. 19, 2014 (JP) ..... 2014-167009

(51) Int. Cl.

| | |
|---|---|
| ***D21H 19/20*** | (2006.01) |
| ***B65D 65/40*** | (2006.01) |
| ***D21H 27/10*** | (2006.01) |
| ***D21H 21/14*** | (2006.01) |
| ***B65D 65/42*** | (2006.01) |
| ***D21H 23/22*** | (2006.01) |
| ***D21H 21/16*** | (2006.01) |
| ***D21H 17/11*** | (2006.01) |
| ***D21H 19/22*** | (2006.01) |

(52) U.S. Cl.
CPC ..... *D21H 19/20* (2013.01); *B65D 65/40* (2013.01); *B65D 65/42* (2013.01); *D21H 17/11* (2013.01); *D21H 19/22* (2013.01); *D21H 21/14* (2013.01); *D21H 21/16* (2013.01); *D21H 23/22* (2013.01); *D21H 27/10* (2013.01)

(58) Field of Classification Search
CPC ..... D21H 19/20; D21H 27/10; D21H 21/14; D21H 23/22; B65D 65/42
USPC ..... 428/511
See application file for complete search history.

(56) References Cited

U.S. PATENT DOCUMENTS

| | | | | |
|---|---|---|---|---|
| 6,472,470 | B1 * | 10/2002 | Fujiwara | C08F 8/12 524/557 |
| 2007/0015867 | A1 | 1/2007 | Maekawa et al. | |
| 2012/0225300 | A1 * | 9/2012 | Kawana | C09K 3/18 428/421 |
| 2014/0178609 | A1 | 6/2014 | Kawagoe et al. | |
| 2014/0343207 | A1 | 11/2014 | Sasaki et al. | |
| 2015/0191874 | A1 | 7/2015 | Kawana et al. | |

FOREIGN PATENT DOCUMENTS

| | | | |
|---|---|---|---|
| CN | 102666772 | A | 9/2012 |
| CN | 103224585 | A | 7/2013 |
| JP | 2002006749 | * | 1/2002 |
| JP | 2009-35689 | A | 2/2009 |
| JP | 2009-102771 | A | 5/2009 |
| JP | 2010-275647 | A | 12/2010 |
| JP | 4752760 | B2 | 8/2011 |
| JP | 2014-234556 | A | 12/2014 |
| WO | 02/31261 | A1 | 4/2002 |
| WO | 2011/059039 | A1 | 5/2011 |
| WO | 2013/115196 | A1 | 8/2013 |
| WO | WO 2013/160199 | A1 | 10/2013 |
| WO | WO 2014/098240 | A1 | 6/2014 |

OTHER PUBLICATIONS

Translation of JP 2002-006749, Jan. 11, 2002/ (Year: 2002).*
Extended European Search Report dated Dec. 22, 2017 in Patent Application No. 15834070.3, 5 pages.
International Search Report dated Oct. 27, 2015 in PCT/JP2015/073280 filed Aug. 19, 2015.

* cited by examiner

*Primary Examiner* — Hui H Chin
(74) *Attorney, Agent, or Firm* — Oblon, McClelland, Maier & Neustadt, L.L.P.

(57) ABSTRACT

The paper composite contains: a paper substrate having an air permeation resistance of 1,000 sec or less and bulk density of from 0.5 to 1.0 g/cm$^3$; and a greaseproof layer on at least one side thereof, the greaseproof layer containing an ethylene-vinyl alcohol polymer (A) and a cationic fluorine-containing polymer (B) having two specific constitutional units. A content of the copolymer (B) in the greaseproof layer is from 5 to 50 parts by mass with respect to 100 parts by mass of the polymer (A), an amount of the greaseproof layer on dry mass basis is from 0.1 to 3.0 g/m$^2$, and a water vapor permeability of the paper composite is 1,000 g/m$^2$·24 h or greater.

4 Claims, No Drawings

PAPER COMPOSITE, PACKAGING MATERIAL, AND PRODUCTION METHOD OF PAPER COMPOSITE

TECHNICAL FIELD

The present invention relates to a paper composite, a packaging material, and a production method of the paper composite.

BACKGROUND ART

For packaging materials for foodstuffs, etc., greaseproof paper with grease resistance imparted thereto is widely used. The greaseproof paper is defined as "1) a collective designation of a paper having oil resistance, and 2) a paper or board which is extremely resistant to permeation of grease or fats." in JIS-P0001 (1998) "Paper, board and pulp—Vocabulary". Greaseproof paper is used for packaging a foodstuff, which contains a large amount of oil or a grease component, such as chocolate, pizza and a doughnut, in order to prevent grease from permeating a packaging material. This is because, if oil or a grease component contained in a foodstuff permeates a packaging material, grease may reach a surface not in contact with the foodstuff, resulting in a grease stain which may: deteriorate appearance and thus reduce a commercial value; darken a printed part and thus reduce readability of printed characters; and deteriorate OCR suitability of a bar code or the like. Furthermore, since grease may transfer to clothes and cause a problem of stain and the like, greaseproof paper in which grease resistance has been imparted to a portion to be in contact with a foodstuff is used.

Conventionally, a fluorine compound, particularly a perfluoro fluorine compound has been used as a greaseproofing agent for developing grease resistance of greaseproof paper. Unlike non-fluorine-type greaseproof paper such as glassine paper, parchment paper, coated paper and laminated paper, or a plastic film, fluorine-type greaseproof paper provides superior water resistance and grease resistance while providing breathability (particularly water vapor permeability), and thus has been suitably used for packaging of a foodstuff such as deep-fried food that requires prevention of humidity accumulating inside a package, and for packaging a freshness preservative or a deoxidant that functionally requires breathability.

Among methods of water proofing and grease proofing of paper, in an additive processing method in which a paper substrate is impregnated or coated with a processing agent, a size press or various types of coaters are used; and a copolymer of vinylidene chloride with a (meth)acrylate having a polyfluoroalkyl group has been proposed. However, a short immersion time period may result in problems of insufficient adsorption to the paper and in turn inferior water resistance and grease resistance, and of reduced water resistance of the paper due to inferior water resistance.

In order to develop superior grease resistance and superior water resistance, a water repellent and oil resistant composition has been proposed which contains a specific cationic fluorine-based greaseproofing agent, a non-fluorine surfactant, a medium, and a water-soluble polymer selected from a polyacrylamide, polyvinyl alcohol and starch as essential components (refer to Patent Document 1).

Furthermore, in recent years, it has been revealed in connection with fluorine compounds having a perfluoroalkyl group that: perfluorooctane sulfonic acids generated during a fluorine compound production process in an electrolytic polymerization method accumulate widely in environment such as blood of humans and animals, and marine water; and a fluorine compound produced by an electrolytic polymerization method or a telomerization method generates a perfluoroalcohol that is highly environmentally accumulative, due to heating at 100° C. or higher, regardless of the production method. A carbon number of the perfluoroalkyl group is therefore recommended to be less than 8. In this respect, instead of the conventional fluorine-based greaseproofing agent, a novel alternative fluorine-based greaseproofing agent has been proposed, obtained by employing a short perfluoroalkyl group having 6 or less carbon atoms, or a polyfluoropolyether (refer to Patent Document 2).

However, in the case of using for greaseproofing of paper, the environmentally conscious greaseproofing agent as disclosed in Patent Document 2, in which a carbon chain length of the perfluoroalkyl group is 6 or less, is less likely to attain sufficient grease resistance, and thus a large amount of the greaseproofing agent may be required for obtaining desired grease resistance. Therefore, sufficient grease resistance may not be imparted to, for example, thin paper of low grammage, and cardboard with a greaseproof paper layer of low grammage.

PRIOR ART DOCUMENTS

Patent Documents

Patent Document 1: PCT International Publication No. WO2002/031261

Patent Document 2: Japanese Patent Application, Publication No. 2009-035689

SUMMARY OF THE INVENTION

Problems to be Solved by the Invention

The present invention has been made in view of the aforementioned circumstances, and an objective of the invention is to provide a paper composite that is superior in grease resistance, water resistance and water vapor permeability, with an improvement of the grease resistance being enabled upon imparting grease resistance by using a greaseproofing agent having 6 or less carbon atoms, without increasing the amount of the greaseproofing agent used; a packaging material comprising the paper composite; and a production method of the paper composite.

Means for Solving the Problems

The present inventors have thoroughly investigated and consequently found that superior grease resistance, superior water resistance, and superior water vapor permeability are obtained by providing 0.1 g/m$^2$ or greater and 3.0 g/m$^2$ or less, on dry mass basis, of a greaseproof layer containing a specific vinyl alcohol polymer (hereinafter, may be abbreviated as "PVA") (A) and a specific cationic fluorine-containing copolymer (B), on at least one surface side of a paper substrate having an air permeation resistance of 1,000 sec or less and a bulk density of 0.5 g/cm$^3$ or greater and 1.0 g/cm$^3$ or less.

According to an aspect of the invention made for solving the aforementioned problems, a paper composite comprises: a paper substrate having an air permeation resistance of 1,000 sec or less and a bulk density of 0.5 g/cm$^3$ or greater and 1.0 g/cm$^3$ or less; and a greaseproof layer formed on at least one surface side of the paper substrate, wherein the greaseproof layer comprises:

a vinyl alcohol polymer (A) having a content of an ethylene unit of 2 mol % or greater and 10 mol % or less, a viscosity average degree of polymerization of 300 or greater and 2,000 or less, a degree of saponification of 91.5 mol % or greater and 99.5 mol % or less; and a cationic fluorine-containing copolymer (B) having a constitutional unit derived from a monomer (a) being a (meth)acrylate having a polyfluoroalkyl group having 1 to 6 carbon atoms, and a constitutional unit derived from a monomer (b) being a compound represented by the formula (1):

$$CH_2{=}C(R^1)COO\text{-}Q\text{-}N(R^2)(R^3),$$

wherein $R^1$ represents a hydrogen atom or a methyl group; Q represents: an alkylene group having 2 to 3 carbon atoms in which a part or all of hydrogen atoms are substituted with a hydroxyl group, or an alkylene group having 2 to 4 carbon atoms; and $R^2$ and $R^3$ each independently represent a benzyl group or an alkyl group having 1 to 8 carbon atoms, or $R^2$ and $R^3$ taken together represent a morpholino group, a piperidino group or a pyrrolidinyl group together with the nitrogen atom, a content of the cationic fluorine-containing copolymer (B) is 5 parts by mass or greater and 50 parts by mass or less with respect to 100 parts by mass of the vinyl alcohol polymer (A), an amount of the greaseproof layer being overlaid on dry mass basis is 0.1 g/m$^2$ or greater and 3.0 g/m$^2$ or less and a water vapor permeability of the paper composite is 1,000 g/m$^2$·24 h or greater.

According to another aspect of the invention made for solving the aforementioned problems, a packaging material comprises the aforementioned paper composite.

According to another aspect of the invention made for solving the aforementioned problems, a production method of a paper composite comprising: a paper substrate having an air permeation resistance of 1,000 sec or less and a bulk density of 0.5 g/cm$^3$ or greater and 1.0 g/cm$^3$ or less; and a greaseproof layer formed on at least one surface side of the paper substrate, comprises:

a process of coating the at least one surface side of the paper substrate with a composition for forming the greaseproof layer comprising:

a vinyl alcohol polymer (A) having a content of an ethylene unit of 2 mol % or greater and 10 mol % or less, a viscosity average degree of polymerization of 300 or greater and 2,000 or less, a degree of saponification of 91.5 mol % or greater and 99.5 mol % or less; and a cationic fluorine-containing copolymer (B) having a constitutional unit derived from a monomer (a) being a (meth)acrylate having a polyfluoroalkyl group having 1 to 6 carbon atoms, and a constitutional unit derived from a monomer (b) being a compound represented by formula (1):

$$CH_2{=}C(R^1)COO\text{-}Q\text{-}N(R^2)(R^3),$$

wherein $R^1$ represents a hydrogen atom or a methyl group; Q represents: an alkylene group having 2 to 3 carbon atoms in which a part or all of hydrogen atoms are substituted with a hydroxyl group, or an alkylene group having 2 to 4 carbon atoms; and $R^2$ and $R^3$ each independently represent a benzyl group or an alkyl group having 1 to 8 carbon atoms, or $R^2$ and $R^3$ taken together represent a morpholino group, a piperidino group or a pyrrolidinyl group together with the nitrogen atom; and a process of drying the paper substrate having been subjected to the coating, wherein a content of the cationic fluorine-containing copolymer (B) is 5 parts by mass or greater and 50 parts by mass or less with respect to 100 parts by mass of the vinyl alcohol polymer (A), an amount of the greaseproof layer being overlaid on dry mass basis is 0.1 g/m$^2$ or greater and 3.0 g/m$^2$ or less and a water vapor permeability of the paper composite is 1,000 g/m$^2$·24 h or greater.

Effects of the Invention

The paper composite according to the aspect of the present invention is superior in grease resistance, water resistance, and water vapor permeability, with an improvement of the grease resistance being enabled upon imparting grease resistance by using a greaseproofing agent having a 6 or less carbon atoms, without increasing the amount of the greaseproofing agent used. The paper composite is therefore advantageous in providing practical greaseproof paper for a package or a container for various deep-fried foods and grease-containing foods.

DESCRIPTION OF EMBODIMENTS

The present invention is described in detail hereinafter.

<Paper Composite>

<Paper Substrate>

A paper substrate used for obtaining the paper composite of the present invention has an air permeation resistance, which is measured in accordance with JIS-P8117 (2009), of 1,000 sec or less, and a bulk density, which is measured in accordance with JIS-P8118 (1998), of 0.5 g/cm$^3$ or greater and 1.0 g/cm$^3$ or less. With the paper substrate having the air permeation resistance of 1,000 sec or less and the bulk density of 0.5 g/cm$^3$ or greater and 1.0 g/cm$^3$ or less, it is difficult to attain the desired superior grease resistance, water vapor permeability, and water resistance even by providing a conventional fluorine greaseproof layer; however, attaining the objective is enabled by providing a greaseproof layer comprising the PVA (A) and the cationic fluorine-containing copolymer (B) on at least one face in an amount of 0.1 g/m$^2$ or greater and 3.0 g/m$^2$ or less.

The paper substrate is not particularly limited and may be appropriately selected according to intended use, as long as the air permeation resistance thereof is 1,000 sec or less, the bulk density thereof is 0.5 g/cm$^3$ or greater and 1.0 g/cm$^3$ or less, and formation of a greaseproof layer at least on one surface thereof is possible. For example, kraft paper, premium quality paper, cardboard, linerboard, glassine paper, parchment paper, and the like may be preferably used. It is to be noted that a fiber material for the paper substrate is not limited to cellulose and a cellulose derivative. Alternatively, fabric, nonwoven fabric, etc. comprising fiber formed from a material other than cellulose and a cellulose derivative may also be used as a substrate, instead of the paper substrate.

<Greaseproof Layer>

The greaseproof layer is formed on at least one surface side of the paper substrate. The greaseproof layer comprises the PVA (A) and the cationic fluorine-containing copolymer (B).

PVA (A)

The PVA (A) used in the present invention is required to have an ethylene unit, and a content of the ethylene unit is required to be 2 mol % or greater and 10 mol % or less. The lower limit of the content of the ethylene unit is preferably 2.5 mol %, more preferably 3 mol %, and further more preferably 3.5 mol %. The upper limit of the content of the ethylene unit is preferably 9.5 mol %, more preferably 9 mol %, and furthermore preferably 8.5 mol %. In the case of the content of the ethylene unit being less than the lower limit, grease resistance and water resistance of the paper composite to be obtained may be insufficient. In the case of the content of the ethylene unit being greater than the upper limit, the PVA may be insoluble in water, leading to difficulty in coating the paper substrate.

The content of the ethylene unit in the PVA (A) is obtained from, for example, proton NMR of a polyvinyl ester containing an ethylene unit, which is a precursor or a reacetylated product of the PVA (A). More specifically, a polyvinyl ester being obtained is sufficiently purified by reprecipitation at least three times with n-hexane/acetone, followed by drying under reduced pressure at 80° C. for three days, to thereby prepare a polyvinyl ester for analysis. The polymer is then dissolved in DMSO-$d_6$ and measured at 80° C. by employing proton NMR (for example, 500 MHz). The content of the ethylene unit can be calculated based on peaks (from 4.7 ppm to 5.2 ppm) derived from main chain methine of the vinyl ester, and peaks (from 0.8 ppm to 1.6 ppm) derived from main chain methylene of ethylene, the vinyl ester, and a third component.

The viscosity average degree of polymerization (hereinafter abbreviated as "degree of polymerization") of the PVA (A) is 300 or greater and 2,000 or less. The lower limit of the viscosity average degree of polymerization is preferably 320, more preferably 340, and furthermore preferably 350. The upper limit of the viscosity average degree of polymerization is preferably 1,800, more preferably 1,600, and further more preferably 1,500. In the case of the viscosity average degree of polymerization being less than the lower limit, grease resistance of the paper composite to be obtained may be insufficient. In the case of the viscosity average degree of polymerization being greater than the upper limit, an aqueous solution and in turn a blended liquid may be highly viscous, leading to deteriorated coating suitability to the paper substrate, and failure to form a greaseproof layer in a sufficient amount of coating for attaining the performance. The degree of polymerization of the PVA is measured in accordance with JIS-K6726 (1994). More specifically, the degree of polymerization is obtained based on a limiting viscosity [η] (liter/g) measured in water at 30° C. after resaponification and purification of the PVA, by the following equation:

$$P=([\eta]\times 10^4/8.29)^{(1/0.62)}.$$

The degree of saponification of the PVA (A) is 91.5 mol % or greater and 99.5 mol % or less. The lower limit of the degree of saponification is preferably 92 mol %, more preferably 95 mol %, and further more preferably 97 mol %. The upper limit of the degree of saponification is preferably 99.3 mol %, more preferably 99.1 mol %, and further more preferably 99.0 mol %. In the case of the degree of saponification being less than the lower limit, water resistance of the paper composite to be obtained may be insufficient. Meanwhile, the vinyl alcohol polymer having the degree of saponification being greater than the upper limit may cause problems of: a rapid increase of viscosity of the aqueous solution during storage; deposition of a filamentous matter during coating; etc., which may lead to difficulty in stably producing the paper composite.

A production procedure of the PVA (A) is not particularly limited and examples thereof include a well-known procedure such as saponification of a vinyl ester polymer, which has been obtained by copolymerizing ethylene with the aforementioned vinyl ester monomer, in an alcohol or a dimethyl sulfoxide solution.

Examples of the vinyl ester monomer include: vinyl formate; vinyl acetate; vinyl propionate; vinyl valerate; vinyl caprate; vinyl laurate; vinyl stearate; vinyl benzoate; vinyl pivalate; vinyl versatate; and the like, among which vinyl acetate is preferred in light of generation of the PVA.

The vinyl alcohol polymer (A) may contain a monomer unit other than a vinyl alcohol unit, an ethylene unit, and a vinyl ester unit, within a range not leading to impairment of the effects of the present invention. Examples of the unit include: α-olefins such as propylene, 1-butene, isobutene, and 1-hexene; vinyl ethers such as methyl vinyl ether, ethyl vinyl ether, n-propyl vinyl ether, i-propyl vinyl ether, and n-butyl vinyl ether; hydroxy group-containing vinyl ethers such as ethylene glycol vinyl ether, 1,3-propanediol vinyl ether, and 1,4-butanediol vinyl ether; allyl acetate; allyl ethers such as propyl allyl ether, butyl allyl ether, and hexyl allyl ether; monomers having an oxyalkylene group; vinylsilanes such as vinyltrimethoxysilane; isopropenyl acetate; hydroxy group-containing α-olefins such as 3-buten-1-ol, 4-penten-1-ol, 5-hexen-1-ol, 7-octen-1-ol, 9-decen-1-ol, and 3-methyl-3-buten-1-ol; monomers having a sulfonic acid group derived from ethylene sulfonic acid, allyl sulfonic acid, methallyl sulfonic acid, 2-acrylamide-2-methylpropane sulfonic acid, etc.; and monomers having a cationic group derived from vinyloxyethyltrimethylammonium chloride, vinyloxybutyltrimethylammonium chloride, vinyloxyethyldimethylamine, vinyloxymethyldiethylamine, N-acrylamidemethyltrimethylammonium chloride, 3-(N-methacrylamide) propyltrimethylammonium chloride, N-acrylamide ethyltrimethylammonium chloride, N-acrylamidedimethylamine, allyltrimethylammonium chloride, methallyltrimethylammonium chloride, dimethylallylamine, allylethylamine, etc. A content of the monomer varies according to a purpose and an intended use thereof, and is generally 20 mol % or less, and preferably 10 mol % or less.

The PVA (A) may also be a terminal-modified product obtained by copolymerizing a vinyl ester monomer such as vinyl acetate with ethylene in the presence of a thiol compound such as 2-mercaptoethanol, n-octyl mercaptan and n-dodecyl mercaptan, and then saponifying the copolymerization product.

Examples of a procedure of copolymerizing the vinyl ester monomer with ethylene include well-known procedures such as bulk polymerization, solution polymerization, suspension polymerization, and emulsion polymerization. Of these, bulk polymerization that is carried out in the absence of a solvent, and solution polymerization that is carried out in a solvent such as alcohol are generally employed. Example of the alcohol used as the solvent for the solution polymerization include lower alcohols such as methyl alcohol, ethyl alcohol, and propyl alcohol. Examples of an initiator used for the copolymerization include well-known initiators such as azo initiators and peroxide initiators such as 2,2'-azobisisobutyronitrile, 2,2'-azobis(2,4-dimethyl-valeronitrile), benzoyl peroxide and n-propyl peroxydicarbonate. A polymerization temperature is not particularly limited and a range of from 0° C. to 150° C. is appropriate. However, in selection of polymerization conditions, as is clear from Examples presented later, it is necessary to appropriately define various conditions such that the PVA required for the objective of the present invention is obtained.

As to the saponification, examples of an alkaline substance used as a saponification catalyst include potassium hydroxide and sodium hydroxide. The lower limit of a molar ratio of the alkaline substance used as a saponification catalyst is preferably 0.004 and further preferably 0.005 with respect to a vinyl acetate unit. Meanwhile, the upper limit of the molar ratio is preferably 0.5 and more preferably 0.1. The saponification catalyst may be added either at once in an initial stage of a saponification reaction, or additionally in the course of the saponification reaction. Examples of the solvent for the saponification reaction include methanol, methyl acetate, dimethylsulfoxide, dimethylformamide, and the like. Of these solvents, methanol is preferred in light of the reactivity. The lower limit of a temperature of the saponification reaction is preferably 5° C., and preferably 20° C. Meanwhile, the upper limit of the temperature is preferably 80° C., and more preferably 70° C. The lower limit of a saponification time is preferably 5 min, and more preferably 10 min. Meanwhile, the upper limit of the saponification time is preferably 10 hrs, and more preferably 5 hrs. As a saponification procedure, well-known procedures such as a batch procedure and a continuous procedure can be employed.

Examples of a washing liquid include methanol, acetone, methyl acetate, ethyl acetate, hexane, water, and the like, among which methanol, methyl acetate, water alone, and a blended liquid are more preferred. The lower limit of an amount of the washing liquid is generally preferably 30 parts by mass and more preferably 50 parts by mass, with respect to 100 parts by mass of the PVA. Meanwhile, the upper limit of the amount of the washing liquid is preferably 10,000 parts by mass and more preferably 3,000 parts by mass. The lower limit of a washing temperature is preferably 5° C. and more preferably 20° C. Meanwhile, the upper limit of the washing temperature is preferably 80° C. and more preferably 70° C. The lower limit of a washing time period is preferably 20 min and more preferably 1 hour. Meanwhile, the upper limit of the washing time period is preferably 10 hrs and more preferably 6 hrs. As a washing procedure, well-known procedures such as a batch procedure and a countercurrent washing procedure can be employed.

Cationic Fluorine-Containing Copolymer (B)

The cationic fluorine-containing copolymer (B) is a fluorine-containing polymer having: a constitutional unit derived from a monomer (a); and a constitutional unit derived from a monomer (b). In addition to the constitutional unit derived from a monomer (a) and the constitutional unit derived from a monomer (b), another constitutional unit may also be contained.

Monomer (a)

The monomer (a) is a (meth)acrylate having a polyfluoroalkyl group having 1 to 6 carbon atoms. The "polyfluoroalkyl group" is a group in which a part or all of hydrogen atoms of an alkyl group are substituted with fluorine atom(s). The "(meth)acrylate" is a generic name for acrylates and methacrylates.

As the "(meth)acrylate having a polyfluoroalkyl group", a compound represented by the following formula (2) is preferred.

$$R^f\text{-L-OCO—C}(R^4)\text{=CH}_2 \quad (2)$$

In the formula, $R^f$ represents a polyfluoroalkyl group having 1 to 6 carbon atoms. L represents a divalent organic group. $R^4$ represents a hydrogen atom or a methyl group. It is to be noted that in "$R^f$-L-" in the formula (2), "$R^f$" and "L" are defined such that all carbon atoms bonding to a fluorine atom are included in $R^f$, and the number of carbon atoms included in L is the largest among remaining carbon atoms. For example, in the case of "$R^f$-L-" being "$CF_2H$—$CH_2$—CH(OH)—$CH_2$—", "$R^f$" represents "$CF_2H$—", and "-L-" represents "—$CH_2$—CH(OH)—$CH_2$—".

The carbon number of the polyfluoroalkyl group $R^f$ is 1 to 6, in light of reduction of environmental load. In light of grease resistance of the greaseproof paper to be obtained, preferably 3 to 6, more preferably 4 to 6, and particularly preferably 6.

The polyfluoroalkyl group in the monomer (a) is preferably a perfluoroalkyl group in which all hydrogen atoms of the alkyl group are substituted with fluorine atoms is preferred.

Preferred specific examples of the monomer (a) include the followings:

$C_6F_{13}C_2H_4OCOC(CH_3)$=$CH_2$,
$C_6F_{13}C_2H_4OCOCH$=$CH_2$,
$C_6F_{13}C_2H_4OCOCCl$=$CH_2$,
$C_4F_9C_2H_4OCOC(CH_3)$=$CH_2$,
$C_4F_9C_2H_4OCOCH$=$CH_2$ and
$C_4F_9C_2H_4OCOCCl$=$CH_2$.

The monomer (a) may be used either alone or in combination of two or more types thereof. As the monomer (a), $C_6F_{13}C_2H_4OCOC(CH_3)$=$CH_2$, $C_6F_{13}C_2H_4OCOCH$=$CH_2$ and $C_6F_{13}C_2H_4OCOCCl$=$CH_2$ are more preferred, and $C_6F_{13}C_2H_4OCOCH$=$CH_2$ and $C_6F_{13}C_2H_4OCOC(CH_3)$=$CH_2$ are particularly preferred.

Monomer (b)

The monomer (b) is a compound represented by the following formula (1):

$$CH_2\text{=C}(R^1)\text{COO-Q-N}(R^2)(R^3) \quad (1)$$

$R^1$ represents a hydrogen atom or a methyl group. Q represents: a group in which a part or all of hydrogen atoms in an alkylene group having 2 to 3 carbon atoms is substituted with hydroxyl group (s); or an alkylene group having 2 to 4 carbon atoms. Q is preferably an alkylene group having 2 to 4 carbon atoms is preferred.

$R^2$ and $R^3$ each independently represents a benzyl group or an alkyl group having no less than 1 and no greater than 8 carbon atoms; or $R^2$ and $R^3$ taken together represent a morpholino group, a piperidino group, or a pyrrolidinyl group together with a nitrogen atom. As $R^2$ and $R^3$, an alkyl group having no less than 1 and no greater than 8 carbon atoms is preferred, and a methyl group or an ethyl group is particularly preferred.

A structural unit derived from the compound (1) in the cationic fluorine-containing copolymer (B) has a tertiary substituted amino group as shown in the above formula (1). By virtue of the cationic fluorine-containing copolymer (B) having the tertiary substituted amino group, the present paper composite is particularly superior in water vapor permeability.

Examples of the monomer (b) include N,N-dimethylaminoethyl (meth)acrylate, N,N-diethylaminoethyl (meth)acrylate, N,N-dimethylaminopropyl (meth)acrylate, N,N-diethylaminopropyl (meth)acrylate, N,N-diisopropylaminoethyl (meth)acrylate, N,N-diethylaminopropyl (meth)acrylamide, and the like.

The cationic fluorine-containing copolymer (B) may contain a constitutional unit derived from a monomer (c), other than the constitutional unit derived from the monomer (a) and the constitutional unit derived from the monomer (b). Two or more types of the constitutional units derived from the monomer (c) may be contained. Examples of the monomer (c) include 2-hydroxyethyl (meth)acrylate, 2-hydroxypropyl (meth)acrylate, 2-hydroxybutyl (meth)acrylate, 4-hydroxybutyl (meth)acrylate, polyoxyethyleneglycol mono (meth)acrylate, polyoxypropyleneglycol mono(meth) acrylate, metoxypolyoxyethyleneglycol (meth)acrylate, a 2-butanone oxime adduct of 2-isocyanatoethyl (meth)acrylate, a pyrazole adduct of 2-isocyanateethyl (meth)acrylate, a 3,5-dimethylpyrazole adduct of 2-isocyanatoethyl (meth) acrylate, a 3-methylpyrazole adduct of 2-isocyanatoethyl (meth)acrylate, an ε-caprolactam adduct of 2-isocyanatoethyl (meth)acrylate, a 2-butanone oxime adduct of 3-isocyanatopropyl (meth)acrylate, a pyrazole adduct of 3-isocyanatopropyl (meth)acrylate, a 3,5-dimethylpyrazole adduct of 3-isocyanatopropyl (meth)acrylate, a 3-methylpyrazole adduct of 3-isocyanatopropyl(meth)acrylate, an ε-caprolactam adduct of 3-isocyanatopropyl(meth)acrylate, a 2-butanone oxime adduct of 4-isocyanatobutyl (meth) acrylate, a pyrazole adduct of 4-isocyanatobutyl (meth) acrylate, 3,5-dimethylpyrazole adduct of 4-isocyanatobutyl (meth)acrylate, a 3-methylpyrazole adduct of 4-isocyanatobutyl (meth)acrylate, an ε-caprolactam adduct of 4-isocyanatobutyl (meth)acrylate, 3-methacryloyloxypropyltrimethoxysilane, 3-methacryloyloxypropyldimethoxymethylsilane, 3-methacryloyloxypropyltriethoxysilane, 3-methacryloyloxypropyldiethoxyethylsilane, allyltrimethoxysilane, glycidyl (meth)acrylate, polyoxyalkylene glycol monoglycidyl ether (meth)acrylate, ethylene glycol di(meth)acrylate, triethylene glycol di(meth)acrylate, tetraethylene glycol di(meth)acrylate, polyethylene glycol di(meth)acrylate, propylene glycol di(meth)acrylate, polypropylene glycol di(meth)acrylate, polytetramethylene glycol di(meth)acrylate, 1,6-hexanediol di(meth)acrylate, neopentyl glycol di(meth)acrylate, poly (ethylene glycol-propylene glycol) di(meth)acrylate, poly (ethylene glycol-tetramethylene glycol) di(meth)acrylate, poly(propylene glycol-tetramethylene glycol) di(meth)acrylate, diethyleneglycol diglycidyl di(meth)acrylate, polyethylene glycol diglycidyl di(meth)acrylate, propylene glycol diglycidyl di(meth)acrylate, polypropylene glycol di(meth) acrylate, glycerin diglycidyl ether di(meth)acrylate, 2-hydroxy-3-acryloyloxypropyl methacrylate, allyloxypolyethylene glycol mono(meth)acrylate, allyloxypoly(ethylene glycol-propylene glycol) mono(meth)acrylate, glycerin di(meth)acrylate, oxyalkylene glycol mono(meth)acrylate, mono-isocyanatoethyl (meth)acrylate, oxyalkylene glycol diisocyanatoethyl (meth)acrylate ethylene, vinylidene chloride, vinyl chloride, (meth)acrylic acid, vinylidene fluoride, vinyl acetate, vinyl propionate, vinyl isobutanoate, vinyl isodecanoate, vinyl stearate, vinylpyrrolidone, cetyl vinyl ether, dodecyl vinyl ether, isobutyl vinyl ether, ethyl vinyl ether, 2-chloroethyl vinyl ether, styrene, α-methylstyrene, p-methylstyrene, (meth)acrylamide, N,N-dimethyl (meth) acrylamide, diacetone (meth)acrylamide, methylolated diacetone (meth)acrylamide, vinylalkylketone, butadiene, isoprene, chloroprene, benzyl (meth)acrylate, (meth)acrylate having polysiloxane, allyl acetate, N-vinylcarbazole, maleimide, N-methylmaleimide, and the like.

With respect to the total constitutional units (100% by mass) of the cationic fluorine-containing copolymer (B), a content of the constitutional unit derived from the monomer (a) is preferably 50% by mass or greater and 98% by mass or less, and a content of the constitutional unit derived from the monomer (b) is preferably 2% by mass or greater and 50% by mass or less, in the cationic fluorine-containing copolymer (B). In the case in which the constitutional unit derived from the monomer (c) is contained, a content thereof is preferably 40% by mass or less with respect to the total constitutional units of the cationic fluorine-containing copolymer (B) (100% by mass).

The lower limit of a weight average molecular weight of the cationic fluorine-containing copolymer (B) is preferably 5,000, and more preferably 20,000. Meanwhile, the upper limit of the weight average molecular weight is preferably 100,000, and more preferably 90,000. In the case of the weight average molecular weight being the lower limit or greater, water resistance and grease resistance are favorable. In the case of the weight average molecular weight being the upper limit or less, film-forming properties and liquid stability are favorable.

The weight average molecular weight of the cationic fluorine-containing copolymer (B) is a molecular weight in terms of polymethyl methacrylate equivalent, obtained by measuring by gel permeation chromatography using a calibration curve produced by using a standard polymethyl methacrylate sample.

The cationic fluorine-containing copolymer (B) in the present invention is obtained by a polymerization reaction of monomers in a solvent for polymerization, in accordance with a well-known procedure.

Subsequent to the polymerization reaction of the monomers to obtain the cationic fluorine-containing copolymer (B), it is preferred to convert the substituted amino group in the copolymer (B) into an amine salt. Accordingly, dispersibility of the copolymer (B) in an aqueous medium is improved.

For conversion into the amine salt, an acid or the like is preferably used. Examples of the acid include hydrochloric acid, hydrobromic acid, sulfonic acid, nitric acid, phosphoric acid, citric acid, malic acid, acetic acid, formic acid, propionic acid, lactic acid, and the like, among which acetic acid and malic acid are more preferred.

In the paper composite of the present invention, containing both the PVA (A) and the cationic fluorine-containing copolymer (B) in the greaseproof layer is essential. Using the PVA (A) and the cationic fluorine-containing copolymer (B) in combination enables a significant reduction of the required amount of the composition for forming a greaseproof layer coating the paper substrate for attaining desired performance. In this case, the amount of the coating the paper substrate is 0.1 $g/m^2$ or greater and 3.0 $g/m^2$ or less on dry mass basis, on at least one surface side of the paper substrate. The lower limit of the amount of the coating is preferably 0.3 $g/m^2$, in light of a further improvement of the effects of the presently claimed invention. The upper limit of the amount of the coating is preferably 2.5 $g/m^2$, more preferably 2.0 $g/m^2$, and further more preferably 1.5 $g/m^2$. In the case of the coating amount being less than the lower limit, sufficient grease resistance may not be obtained. The "amount of the greaseproof layer being overlaid" as referred to herein means: in the case of forming only one greaseproof layer, an overlaid amount of the layer; and in the case of forming multiple greaseproof layers, a sum of overlaid amounts of all of the greaseproof layers.

The upper limit of the content of the cationic fluorine-containing copolymer (B) is 50 parts by mass, preferably 40 parts by mass, and more preferably 30 parts by mass with respect to 100 parts by mass of the PVA (A). Meanwhile, the lower limit of the content is 5 parts by mass, preferably 10 parts by mass, and more preferably 15 parts by mass.

The water vapor permeability (moisture permeability) of the paper composite of the embodiment of the present invention in accordance with JIS-Z0208 (1976) is required to be 1,000 $g/m^2 \cdot 24$ h or greater, preferably 1,500 $g/m^2 \cdot 24$ h or greater, and particularly preferably 2,000 g/m$^2$·24 h or greater. In the case of the water vapor permeability being less than the lower limit, if fresh-fried food is put in a bag comprising the present paper composite and then sealed, condensation is formed in the bag, whereby batter is moistened and excessively softened, leading to significant deterioration in flavor.

<Production Method of Paper Composite>

A production method of the paper composite of the embodiment of the present invention is described hereinafter. The paper composite to be produced according to the present invention comprises: a paper substrate having an air permeation resistance of 1,000 sec or less and a bulk density of 0.5 g/cm$^3$ or greater and 1.0 g/cm$^3$ or less; and a greaseproof layer formed on at least one surface side of the paper substrate, wherein a water vapor permeability of the paper composite is 1,000 g/m$^2$·24 h or greater. The production method of the paper composite comprises: a process of coating the at least one surface side of the paper substrate with a composition for forming the greaseproof layer, the composition comprising the vinyl alcohol polymer (A) and the cationic fluorine-containing copolymer (B); and a process of drying the paper substrate having been subjected to the coating.

<Coating Process>

Composition for Forming Greaseproof Layer

In the composition for forming the greaseproof layer, a content of the cationic fluorine-containing copolymer (B) is 5 parts by mass or greater and 50 parts by mass or less with respect to 100 parts by mass of the vinyl alcohol polymer (A). A suitable form of the composition for forming the greaseproof layer is a coating liquid. A preparation procedure of the coating liquid is not particularly limited; however, a procedure of mixing the PVA (A) having been dissolved in a solvent, with the cationic fluorine-containing copolymer (B) having been dispersed or dissolved in an aqueous medium is preferred. The aqueous medium is acceptable as long as it is a liquid comprising water in which a content of a volatile organic solvent is no greater than 1% by mass. Specifically, the aqueous medium is preferably water, and an azeotropic mixture comprising water.

The coating liquid may also contain various types of additives. In addition, well-known additives used in paper production processes, such as a paper strengthening agent, a sizing agent, a defoaming agent, a penetrant, a pH adjusting agent, a release agent, an organic or inorganic filler, and the like may also be contained as needed. Examples of the additives include: resins such as starch, cation-modified starch, hydroxyethylated starch, oxidized starch, enzyme-modified starch, a vinyl alcohol polymer, a modified vinyl alcohol polymer, a polyamidoamine, a polyamidoamine-epichlorohydrin modified product, a condensate or preliminary condensate of urea or melamine formaldehyde, condensates of methylol-dihydroxyethylene-urea and a derivative thereof, condensates of uron, condensates of methylol-ethylene-urea, condensates of methylol-propylene-urea, condensates of methylol-triazone, and condensates of dicyandiamide-formaldehyde, AKD, and a cationic acrylic resin; penetrants such as a dendrimer-type alcohol-based penetrant, and an acetylene glycol-based penetrant; and defoaming agents such as a silicone-based defoaming agent, a dendrimer-type alcohol-based defoaming agent, and an acetylene glycol-based defoaming agent.

As a procedure of coating at least one surface side of the paper substrate with the composition for forming the greaseproof layer, a well-known procedure is generally employed, for example a procedure of coating one side or both sides of paper with the coating liquid by using devices such as a size press, a gate roll coater, and a bar coater. The coating liquid may permeate the paper substrate.

The coating is performed such that the amount of the greaseproof layer having been overlaid falls within the above range on dry mass basis.

<Drying Process>

Drying of the paper substrate subsequent to the coating with the composition for forming the greaseproof layer can be performed by, for example, hot air, infrared rays, a heating cylinder, and a procedure comprising a combination thereof. The drying, a heat treatment, etc. at a temperature of 60° C. or greater are preferred. After the drying, the paper composite is obtained. In addition, conditioning and calendering of the paper composite subsequent to the drying enable further improvement of barrier properties. As conditions for the calendering, a roller temperature of normal temperature (25° C.) or higher and 100° C. or lower, and a roller linear pressure of 20 kg/cm or greater and 300 kg/cm or less are preferred. The drying, heat treatment, etc., enable development of further superior grease resistance and water resistance.

<Packaging Material>

The paper composite according to the embodiment of the present invention is suitable for a packaging material. Given this, the present invention encompasses a packaging material comprising the aforementioned paper composite. The packaging material of this embodiment of the present invention may be composed by employing the aforementioned paper composite instead of well-known greaseproof paper used for a packaging material.

EXAMPLES

The present invention is described more in detail hereinafter by way of Examples; however, the present invention is not limited to these Examples.

Evaluation of Paper Substrate and Paper Composite (1) Grease Resistance Evaluation: Kit Test A general grease resistance was measured in accordance with TAPPI UM557 "Repellency of Paper and Board to Grease, Oil, and Waxes (Kit Test)".

(2) Air Permeation Resistance (Seconds)

Measurement was conducted by using an Oken type smoothness and air-permeability tester, in accordance with JIS-P8117 (2009). A value of air permeation resistance indicates a time required for 100 ml air to permeate a predetermined area. Therefore, a greater value of the air permeation resistance indicates poorer air permeation.

(3) Water Vapor Permeability (g/m$^2$·24 h)

Measurement was conducted in accordance with a moisture permeability test method defined in JIS-Z0208 (1976) (cup method), under conditions involving a temperature of 40±0.5° C. and relative humidity of 90±2%. The moisture permeability of 1,000 to 5,000 g/m$^2$·24 h was determined to be favorable in terms of suitability for use in food packaging, not causing condensation in a bag and moisture absorption from the outside of the bag.

(4) Evaluation of Water Absorbing Property

<Cobb Water Absorption (g/m$^2$)>

An amount of water absorbed (g/m$^2$) was measured in accordance with JIS-P8140 (1998), with a contact time of a surface of the paper composite with water being 60 sec. Hereinafter, the "Cobb water absorption" as referred to means Cobb water absorption with a contact time of 60 sec.

Example 1: Production Method of Vinyl Alcohol Polymer 107.2 kg of vinyl acetate (VAc) and 42.8 kg of methanol (MeOH) were charged into a pressure reactor of 250 L equipped with a stirrer, a nitrogen inlet port, an initiator addition port, and a delay solution addition port. The mixture was then heated up to 60° C., followed by subjecting to nitrogen substitution in the system for 30 min by means of nitrogen bubbling. Thereafter, ethylene was introduced to be charged such that the reactor pressure was 5.9 kg/cm$^2$. A solution in which 2,2'-azobis(4-methoxy-2,4-dimethylvaleronitrile) (AMV) was dissolved in methanol in a concentration of 2.8 g/L was prepared as an initiator, and subjected to nitrogen substitution by means of bubbling with nitrogen gas. An internal temperature of the polymerization reactor was adjusted to 60° C., and then 204 ml of the aforementioned initiator solution was injected to thereby initiate polymerization. The polymerization was allowed by the aforementioned initiator solution while continuously adding an AMV solution at 640 ml/hr, and during the polymerization, the reactor pressure at 5.9 kg/cm$^2$ and the polymerization temperature at 60° C. were maintained by introduction of ethylene. Four hours later, the polymerization was terminated by cooling, when a rate of polymerization became 30%. The reactor was opened to remove ethylene, followed by bubbling of nitrogen gas to completely remove ethylene. Thereafter, unreacted vinyl acetate monomer was removed under a reduced pressure to obtain a methanol solution of polyvinyl acetate. Methanol was added to the polyvinyl acetate solution thus obtained to prepare a methanol solution of polyvinyl acetate having a concentration of 30% by mass (polyvinyl acetate in the solution: 100 g). To 333 g of the methanol solution of polyvinyl acetate was added an alkali solution (10% methanol solution of NaOH) in an amount of 46.5 g (molar ratio (MR) with respect to the vinyl acetate unit in the polyvinyl acetate: 0.05) to conduct saponification. About 1 minute after the addition of the alkali, a gelled matter in the system was ground by a grinder and left to stand for 1 hour at 40° C. to proceed saponification. Thereafter, 1,000 g of methyl acetate was added to neutralize remaining alkali. Following confirmation of completion of the neutralization by using a phenolphthalein indicator, a white solid PVA was obtained by filtration, and 1,000 g of methanol was added thereto, which mixture was left to stand for 3 hrs at room temperature to permit washing. After conducting the washing operation 3 times, PVA was obtained by deliquoring through centrifugation, and then left to stand in a dryer at 70° C. for 2 days, to thereby obtain dry PVA (PVA-1).

Viscosity Average Degree of Polymerization and Degree of Saponification of PVA

A viscosity average degree of polymerization and a degree of saponification of the PVA were determined by methods defined in JIS-K6726 (1994). The results are shown in Table 2.

Production Method of Cationic Fluorine-Containing Copolymer 114.0 g of $C_6F_{13}C_2H_4OCOC(CH_3)=CH_2$ (a), 18.0 g of N,N-diethylaminoethyl methacrylate (b), 16.5 g of 2-hydroxyethylmethacrylate (C1), 1.5 g of $CH_2=C(CH_3)COO(C_2H_4O)_3COC(CH_3)=CH_2$, 450 g of acetone, and 1.2 g of dimethyl 2,2'-azobis isobuthyrate were charged into a glass container of 1 L, and nitrogen substitution was repeated 3 times. A polymerization reaction was allowed at 65° C. for 16 hrs, with a stirring rotation frequency of 350 rpm, to thereby obtain a light yellow solution with a solid content concentration of 20% by mass.

Water and acetic acid were added to 100 g of the light yellow solution thus obtained, followed by stirring of the mixture for 30 minutes using a homo mixer. Acetone was distilled off under reduced pressure at 65° C. to obtain a light yellow aqueous dispersion, and thus an aqueous dispersion with a solid content concentration of 20% by mass (aqueous dispersion of the cationic fluorine-containing copolymer (B)) was obtained by using ion exchanged water.

Preparation of Coating Liquid

A 10% by mass aqueous solution of the PVA obtained in the foregoing process was prepared, and then the aqueous solution was mixed with the aforementioned aqueous dispersion such that the cationic fluorine-containing copolymer (B) in the aqueous dispersion was present in an amount of 50 parts by mass with respect to 100 parts by mass of PVA in the aqueous solution. A coating liquid was obtained by adjusting the mixture such that a solid content concentration was 4% by mass.

Formation of Paper Composite

Both faces of a paper substrate having a grammage of 70 g/m$^2$, a bulk density of 0.5 g/cm$^3$, and an air permeability resistance of 15 sec were coated with the coating liquid obtained in the foregoing process by using a two-roll size press machine for testing (Kumagai Riki Kogyo Co., Ltd.) to thereby obtain a paper composite. The coating was conducted under conditions of 50° C. and 100 m/min, and then drying was conducted at 100° C. for 5 min. A coating amount of the coating liquid on dry mass basis was 2.5 g/m$^2$ (total amount of both faces). The paper composite thus obtained was conditioned at 20° C. and 65% RH for 72 hrs.

Evaluation of Paper Composite

The grease resistance, the air permeability resistance, the water vapor permeability, and the water absorbing property of the paper composite thus obtained were evaluated in accordance with the aforementioned procedures. In the grease resistance evaluation, a kit value was 7. The air permeability resistance was 15 sec, the water vapor permeability was 4,800 g/m$^2$·24 h, and the cobb water absorption was 20 g/m$^2$, each of which was determined to have attained a practically suitable level.

Example 2 to Example 15

(PVA-2) to (PVA-8) were obtained by the production procedure of the vinyl alcohol polymer modified as shown in Table 1. Results of analyses of (PVA-2) to (PVA-8) are shown in Table 2. Coating liquids were prepared by employing the PVAs thus obtained, according to formulae shown in Table 3; and a surface of the paper substrate was coated with each of the coating liquids by a procedure similar to that of Example 1, to thereby obtain paper composites. The paper composites were evaluated in accordance with aforementioned procedures. The results are shown in Table 3.

TABLE 1

| | Polymerization Temperature (° C.) | Vac (kg) | MeOH (kg) | Polymerization Ethylene Pressure (kg/cm$^2$) | Initiator Type* | Initiator Charged Amount (mL) | Initiator Total Added Amount (mL) | Polymerization Time Period (hr) | Polymerization Rate (%) | Amount of Saponified Alkali (MR) |
|---|---|---|---|---|---|---|---|---|---|---|
| PVA-1 | 60 | 107 | 42.8 | 5.9 | AMV | 204 | 640 | 4 | 30 | 0.05 |
| PVA-2 | 60 | 120 | 30.1 | 4.7 | AMV | 116 | 360 | 4 | 25 | 0.1 |
| PVA-3 | 60 | 76.6 | 73.3 | 6.5 | AMV | 175 | 552 | 3 | 20 | 0.02 |
| PVA-4 | 60 | 76.6 | 73.3 | 6.5 | AMV | 175 | 552 | 3 | 20 | 0.1 |
| PVA-5 | 60 | 106 | 43.9 | 1.4 | AMV | 53 | 168 | 4 | 20 | 0.05 |
| PVA-6 | 60 | 78.3 | 71.7 | 5.7 | AMV | 255 | 804 | 10 | 60 | 0.05 |
| PVA-7 | 60 | 123 | 26.9 | 2.6 | AMV | 355 | 1118 | 7 | 50 | 0.05 |
| PVA-8 | 60 | 107 | 42.8 | 5.9 | AMV | 204 | 640 | 4 | 30 | 0.015 |

*AMV: Methanol solution of 2,2'-azobis(4-methoxy-2,4-dimethylvaleronitrile) (concentration: 2.8 g/L)

TABLE 2

| | Content of Ethylene Unit (mol %) | Degree of Polymerization | Degree of Saponification (mol %) |
|---|---|---|---|
| PVA-1 | 7 | 1000 | 98.5 |
| PVA-2 | 5 | 1500 | 99.5 |
| PVA-3 | 5 | 1500 | 96.5 |
| PVA-4 | 10 | 500 | 99.0 |
| PVA-5 | 3 | 1500 | 98.5 |
| PVA-6 | 10 | 400 | 96.0 |
| PVA-7 | 3 | 500 | 97.0 |
| PVA-8 | 7 | 1000 | 93.0 |

As shown in Table 3, the paper composites comprising the PVA (A) and the cationic fluorine-containing copolymer (B) within predetermined ranges specified by the present invention exhibited favorable results in all the evaluations of grease resistance, water vapor permeability, and water absorbing property.

Comparative Example 1 to Comparative Example 12

(PVA-9) to (PVA-16) were obtained by the production procedure of the vinyl alcohol polymer modified as shown in Table 4. Results of analyses of (PVA-9) to (PVA-16) are shown in Table 5. Coating liquids were prepared by employing the PVAs thus obtained, according to formulae shown in Table 6; and a surface of the paper substrate was coated with each of the coating liquids by a procedure similar to that of

TABLE 3

| | Coating Liquid: PVA Type | Coating Liquid: PVA Blended Amount (parts by mass) | Coating Liquid: Fluorine-containing Copolymer (parts by mass) | Coating Liquid: Applied Amount on Both Faces (g/m$^2$) | Paper Substrate: Air Permeation Resistance (sec) | Paper Substrate: Bulk Density (g/cm$^3$) | Evaluation of Paper Composite: Kit Value | Evaluation of Paper Composite: Air Permeation Resistance (sec) | Evaluation of Paper Composite: Water Vapor Permeability (g/m$^2$ · 24 h) | Evaluation of Paper Composite: Cobb Water Absorption (g/m$^2$) |
|---|---|---|---|---|---|---|---|---|---|---|
| Example 1 | PVA-1 | 100 | 50 | 0.3 | 15 | 0.5 | 7 | 15 | 4,800 | 20 |
| Example 2 | PVA-1 | 100 | 25 | 0.3 | 15 | 0.5 | 5 | 15 | 4,800 | 23 |
| Example 3 | PVA-1 | 100 | 25 | 0.6 | 15 | 0.5 | 7 | 15 | 4,600 | 20 |
| Example 4 | PVA-1 | 100 | 10 | 1.2 | 15 | 0.5 | 7 | 15 | 4,500 | 18 |
| Example 5 | PVA-1 | 100 | 10 | 2.4 | 15 | 0.5 | 9 | 15 | 4,200 | 15 |
| Example 6 | PVA-1 | 100 | 5 | 3.0 | 15 | 0.5 | 9 | 25 | 4,000 | 12 |
| Example 7 | PVA-2 | 100 | 10 | 2.2 | 15 | 0.5 | 10 | 25 | 4,300 | 17 |
| Example 8 | PVA-3 | 100 | 10 | 2.3 | 15 | 0.5 | 8 | 15 | 4,100 | 22 |
| Example 9 | PVA-4 | 100 | 10 | 2.8 | 15 | 0.5 | 8 | 15 | 4,000 | 25 |
| Example 10 | PVA-5 | 100 | 10 | 2.0 | 15 | 0.5 | 9 | 15 | 4,400 | 19 |
| Example 11 | PVA-6 | 100 | 25 | 2.1 | 15 | 0.5 | 7 | 15 | 4,200 | 29 |
| Example 12 | PVA-7 | 100 | 25 | 2.8 | 15 | 0.5 | 9 | 15 | 4,100 | 27 |
| Example 13 | PVA-8 | 100 | 25 | 2.2 | 15 | 0.5 | 9 | 15 | 4,300 | 35 |
| Example 14 | PVA-1 | 100 | 10 | 2.4 | 15 | 0.8 | 9 | 150 | 3,900 | 17 |
| Example 15 | PVA-1 | 100 | 10 | 2.6 | 15 | 1.0 | 9 | 200 | 3,700 | 18 |

Example 1, to thereby obtain paper composites. The paper composites were evaluated. The results are shown in Table 6.

Comparative Example 1 was a paper composite not comprising the cationic fluorine-containing copolymer (B). The paper composite of Comparative Example 1 was inferior in the grease resistance and exhibited a high water absorption, indicating insufficiency for practical use.

Comparative Examples 2 to 5 were paper composites comprising a vinyl alcohol polymer with an ethylene unit content of less than 2 mol %. The paper composite of Comparative Example 2 exhibited a somewhat high water absorption, and the paper composite of Comparative Example 3 exhibited a small kit value. The paper composite of Comparative Example 4 exhibited a small kit value and a somewhat high water absorption, and the paper composite of Comparative Example 5 exhibited a small kit value and

TABLE 4

| | Polymerization Temperature (° C.) | Vac (kg) | MeOH (kg) | Polymerization Ethylene Pressure (kg/cm$^2$) | Initiator Type* | Initiator Charged Amount (mL) | Initiator Total Added Amount (mL) | Polymerization Time Period (hr) | Polymerization Rate (%) | Amount of Saponified Alkali (MR) |
|---|---|---|---|---|---|---|---|---|---|---|
| PVA-9 | 60 | 81.9 | 68 | — | AMV | 224 | 705 | 4 | 40 | 0.05 |
| PVA-10 | 60 | 102 | 48.3 | 2.0 | AMV | 139 | 438 | 5 | 40 | 0.2 |
| PVA-11 | 60 | 102 | 48.3 | 2.0 | AMV | 139 | 438 | 5 | 40 | 0.05 |
| PVA-12 | 60 | 57.5 | 92.5 | — | AMV | 471 | 1484 | 5 | 60 | 0.05 |
| PVA-13 | 60 | 81.9 | 68 | 10.2 | AMV | 500 | 1500 | 4 | 30 | 0.1 |
| PVA-14 | 60 | 107 | 42.8 | 5.9 | AMV | 204 | 640 | 4 | 30 | 0.013 |
| PVA-15 | 20 | 23.1 | 127 | 0.70 | NPP | 198 | 714 | 12 | 75 | 0.1 |
| PVA-16 | 60 | 81.9 | 68 | 0.99 | AMV | 330 | 1200 | 4 | 38 | 0.2 |

*AMV: Methanol solution of 2,2'-azobis(4-methoxy-2,4-dimethylvaleronitrile) (concentration: 2.8 g/L)
NPP: N,N-dimethylaniline solution of n-propyl peroxydicarbonate (concentration: 50% by mass)

TABLE 5

| | Content of Ethylene Unit (mol %) | Degree of Polymerization | Degree of Saponification (mol %) |
|---|---|---|---|
| PVA-9 | 0 | 1000 | 98.5 |
| PVA-10 | 0 | 1000 | 99.9 |
| PVA-11 | 1 | 1500 | 98.5 |
| PVA-12 | 0 | 500 | 99.0 |
| PVA-13 | 15 | 1000 | 98.5 |
| PVA-14 | 7 | 1000 | 90.0 |
| PVA-15 | 5 | 210 | 99.0 |
| PVA-16 | 2 | 1000 | 99.9 |

TABLE 6

| | Coating Liquid: PVA Type | Coating Liquid: PVA Blended Amount (parts by mass) | Coating Liquid: Fluorine-containing Copolymer (parts by mass) | Coating Liquid: Applied Amount on Both Faces (g/m$^2$) | Paper Substrate: Air Permeation Resistance (sec) | Paper Substrate: Bulk Density (g/cm$^3$) | Evaluation of Paper Composite: Kit Value | Evaluation of Paper Composite: Air Permeation Resistance (sec) | Evaluation of Paper Composite: Water Vapor Permeability (g/m$^2$ · 24 h) | Evaluation of Paper Composite: Cobb Water Absorption (g/m$^2$) |
|---|---|---|---|---|---|---|---|---|---|---|
| Comparative Example 1 | PVA-1 | 100 | — | 2.4 | 15 | 0.5 | 0 | 40 | 2,500 | 100 |
| Comparative Example 2 | PVA-9 | 100 | 10 | 2.5 | 15 | 0.5 | 5 | 15 | 4,000 | 40 |
| Comparative Example 3 | PVA-10 | 100 | 10 | 2.4 | 15 | 0.5 | 4 | 15 | 3,800 | 35 |
| Comparative Example 4 | PVA-11 | 100 | 10 | 2.5 | 15 | 0.5 | 4 | 15 | 3,900 | 40 |
| Comparative Example 5 | PVA-12 | 100 | 10 | 3.0 | 15 | 0.5 | 2 | 15 | 3,500 | 120 |
| Comparative Example 6 | PVA-13 | 100 | 10 | *1 | 15 | 0.5 | | | *1 | |
| Comparative Example 7 | PVA-14 | 100 | 10 | 2.8 | 15 | 0.5 | 2 | 15 | 3,200 | 80 |
| Comparative Example 8 | PVA-15 | 100 | 10 | 3.0 | 15 | 0.5 | 2 | 15 | 3,000 | 90 |
| Comparative Example 9 | PVA-16 | 100 | 10 | *2 | 15 | 0.5 | | | *2 | |
| Comparative Example 10 | PVA-1 | 100 | 10 | 2.3 | 15 | 1.2 | 5 | 800 | 2,000 | 80 |
| Comparative Example 11 | PVA-1 | 100 | 10 | 2.6 | 15 | 1.5 | 4 | 1000 | 950 | 75 |
| Comparative Example 12 | PVA-1 | 100 | 25 | 2.4 | 1500 | 1.5 | 3 | over 100000 | 800 | 60 |

*1: Application to paper substrate failed due to PVA-14 being insoluble in water
*2: Application to paper substrate failed due to filamentous matter deposited during application a high water absorption. Given this, the paper composites of Comparative Examples 2 to 5 were not sufficiently suitable for practical use.

In Comparative Example 6, use of a vinyl alcohol polymer with an ethylene unit content of greater than 10 mol % was attempted, which resulted in presence of an undissolved component during preparation of a coating liquid, leading to a failure to obtain a paper composite.

Comparative Example 7 was a paper composite comprising a vinyl alcohol polymer with a degree of saponification of less than 91.5 mol %. The paper composite of Comparative Example 7 exhibited a small kit value and a high water absorption, indicating insufficiency for practical use.

Comparative Example 8 was a paper composite comprising a vinyl alcohol polymer with a degree of polymerization of less than 300. The paper composite of Comparative Example 8 exhibited a small kit value and a high water absorption, indicating insufficiency for practical use.

In Comparative Example 9, use of a vinyl alcohol polymer with a degree of saponification of greater than 99.5 mol % was attempted, which resulted in deposition of a filamentous matter during coating, leading to a failure to stably obtain a paper composite.

Comparative Examples 10 and 11 were paper composites comprising a paper substrate having a bulk density exceeding the predetermined range. The paper composite of Comparative Example 10 exhibited a high air permeability resistance and a high water absorption. The paper composite of Comparative Example 11 exhibited a small kit value, an inferior water vapor permeability of less than 1,000 g/m$^2$·24 h, and a high air permeability resistance, as well as a high water absorption. Given this, the paper composites of Comparative Examples 10 and 11 were not sufficiently suitable for practical use.

Comparative Example 12 was a paper composite comprising a paper substrate having the air permeability resistance exceeding the predetermined range. The paper composite of Comparative Example 12 exhibited a small kit value, an inferior water vapor permeability, a high air permeability resistance, and a high water absorption. Given this, the paper composite of Comparative Example 12 was not sufficiently suitable for practical use.

INDUSTRIAL APPLICABILITY

The paper composite according to the embodiment of the present invention is able to maintain grease resistance to such a degree that no practical problem is resulted even in packaging of oily food, and is superior in air permeability or water vapor permeability, and water resistance, thus being advantageous in providing practical greaseproof paper for a package and a container for various deep-fried foods and grease-containing foods.

The invention claimed is:

1. A paper composite comprising: a paper substrate having an air permeation resistance of 1,000 sec or less and a bulk density of 0.5 g/cm$^3$ or greater and 1.0 g/cm$^3$ or less; and a greaseproof layer formed on at least one surface side of the paper substrate, wherein the greaseproof layer comprises:

a vinyl alcohol polymer (A) having a content of an ethylene unit of 2 mol % or greater and 10 mol % or less, a viscosity average degree of polymerization of 300 or greater and 2,000 or less, and a degree of saponification of 91.5 mol % or greater and 99.5 mol % or less; and a cationic fluorine-containing copolymer (B) having: a constitutional unit derived from a monomer (a) being a (meth)acrylate having a polyfluoroalkyl group having 1 to 6 carbon atoms; and a constitutional unit derived from a monomer (b) being a compound represented by formula (1):

$$CH_2{=}C(R^1)COO\text{-}Q\text{-}N(R^2)(R^3),$$

wherein $R^1$ represents a hydrogen atom or a methyl group; Q represents: an alkylene group having 2 to 3 carbon atoms in which a part or all of hydrogen atoms are substituted with a hydroxyl group, or an alkylene group having 2 to 4 carbon atoms; and $R^2$ and $R^3$ each independently represent a benzyl group or an alkyl group having 1 to 8 carbon atoms, or $R^2$ and $R^3$ taken together represent a morpholino group, a piperidino group or a pyrrolidinyl group together with the nitrogen atom, a content of the cationic fluorine-containing copolymer (B) is 5 parts by mass or greater and 50 parts by mass or less with respect to 100 parts by mass of the vinyl alcohol polymer (A), an amount of the greaseproof layer being overlaid on dry mass basis is 0.1 g/m$^2$ or greater and 3.0 g/m$^2$ or less, and a water vapor permeability of the paper composite is 1,000 g/m$^2$·24 h or greater.

2. The paper composite according to claim 1, wherein the cationic fluorine-containing copolymer (B) has: a content of the constitutional unit derived from the monomer (a) of 50% by mass or greater and 98% by mass or less; and a content of the constitutional unit derived from the monomer (b) of 2% by mass or greater and 50% by mass or less.

3. A packaging material comprising the paper composite according to claim 1.

4. A production method of a paper composite, the production method comprising:

coating the at least one surface side of a paper substrate with a composition for forming a greaseproof layer, the paper substrate having an air permeation resistance of 1,000 sec or less and a bulk density of 0.5 g/cm$^3$ or greater and 1.0 g/cm$^3$ or less, and the composition for forming a greaseproof layer comprising:

a vinyl alcohol polymer (A) having a content of an ethylene unit of 2 mol % or greater and 10 mol % or less, a viscosity average degree of polymerization of 300 or greater and 2,000 or less, and a degree of saponification of 91.5 mol % or greater and 99.5 mol % or less; and a cationic fluorine-containing copolymer (B) having: a constitutional unit derived from a monomer (a) being a (meth)acrylate having a polyfluoroalkyl group having 1 to 6 carbon atoms; and a constitutional unit derived from a monomer (b) being a compound represented by formula (1):

$$CH_2{=}C(R^1)COO\text{-}Q\text{-}N(R^2)(R^3),$$

wherein $R^1$ represents a hydrogen atom or a methyl group; Q represents: an alkylene group having 2 to 3 carbon atoms in which a part or all of hydrogen atoms are substituted with a hydroxyl group, or an alkylene group having 2 to 4 carbon atoms; and $R^2$ and $R^3$ each independently represent a benzyl group or an alkyl group having 1 to 8 carbon atoms, or $R^2$ and $R^3$ taken together represent a morpholino group, a piperidino group or a pyrrolidinyl group together with the nitrogen atom; and drying the paper substrate having been subjected to the coating, to obtain a paper composite comprising: the paper substrate; and a greaseproof layer formed on the at least one surface side of the paper substrate, wherein a content of the cationic fluorine-containing copolymer (B) is 5 parts by mass or greater and 50 parts by mass or less with respect to 100 parts by mass of the vinyl alcohol polymer (A), an amount of the greaseproof layer being overlaid on dry mass basis is 0.1 $g/m^2$ or greater and 3.0 $g/m^2$ or less, and a water vapor permeability of the paper composite is 1,000 $g/m^2 \cdot 24$ h or greater.

* * * * *